United States Patent [19]

Triplett et al.

[11] Patent Number: 4,700,054

[45] Date of Patent: Oct. 13, 1987

[54] ELECTRICAL DEVICES COMPRISING FABRICS

[75] Inventors: James T. Triplett, Livermore; Paul B. Germeraad, Menlo Park; Randolph W. Chan, Sunnyvale; Michael L. Jensen, Mountain View, all of Calif.

[73] Assignee: Raychem Corporation, Menlo Park, Calif.

[21] Appl. No.: 735,428

[22] Filed: May 17, 1985

Related U.S. Application Data

[63] Continuation-in-part of Ser. No. 552,649, Nov. 17, 1983, abandoned.

[51] Int. Cl.[4] ..... H05B 3/34; H05B 3/54

[52] U.S. Cl. ..... 219/545; 219/553

[58] Field of Search ..... 219/505, 528, 529, 545, 219/549, 553; 338/20, 22 R, 22 SD, 211, 212, 214; 264/105; 174/DIG. 8, 110 PM; 252/511

[56] References Cited

U.S. PATENT DOCUMENTS

| | | | |
|---|---|---|---|
| 2,473,183 | 7/1947 | Watson | 219/46 |
| 3,359,524 | 12/1967 | Gallacher et al. | 338/212 |
| 3,400,254 | 9/1968 | Takamori | 219/549 |
| 3,484,585 | 12/1969 | Morey | 219/545 X |
| 3,513,297 | 5/1970 | Jordan | 219/545 |
| 3,751,620 | 8/1973 | Yuasa | 219/211 |
| 3,781,526 | 12/1973 | Damron | 219/553 X |
| 3,808,403 | 4/1974 | Kanaya et al. | 219/528 |
| 4,017,715 | 4/1977 | Whitney et al. | 219/553 |
| 4,246,468 | 1/1981 | Horsma | 219/553 |
| 4,272,471 | 1/1981 | Walker | 264/104 |
| 4,309,596 | 1/1982 | Crowley | 219/549 |
| 4,314,145 | 2/1982 | Horsma | 219/553 |
| 4,329,726 | 5/1982 | Middleman et al. | 338/22 R X |
| 4,330,703 | 5/1982 | Horsma et al. | 219/553 |
| 4,330,704 | 5/1982 | Jensen | 219/553 |
| 4,421,582 | 12/1983 | Horsma et al. | 219/553 X |
| 4,429,216 | 1/1984 | Brigham | 219/528 |
| 4,459,473 | 7/1984 | Kamath | 219/553 |
| 4,485,297 | 11/1984 | Grise et al. | 219/528 |

FOREIGN PATENT DOCUMENTS 1525851 8/1975 United Kingdom .

*Primary Examiner*—L. T. Hix
*Assistant Examiner*—Brian W. Brown
*Attorney, Agent, or Firm*—Timothy H. P. Richardson; Herbert G. Burkard

[57] ABSTRACT

An electrical heater which comprises a fabric prepared from at least one of the electrodes and another elongate element of substantially higher resistance. The heater preferably comprises a PTC element, e.g. of a conductive polymer, to render the heater self-regulating. The PTC element may be in the form of a fiber forming part of the fabric, or a layer surrounding one of the electrodes, or a laminar element in which the fabric is embedded. The fabric can if desired be laminated to a sheet of a polymer, e.g. an insulating polymer or a ZTC conductive polymer. A shrinkable fabric heater can be made by incorporating a heat-shrinkable non-conductive filament into the fabric, perpendicular to both electrodes, and is useful for example for enclosing splices in telephone cables.

10 Claims, 12 Drawing Figures

ELECTRICAL DEVICES COMPRISING FABRICS

CROSS REFERENCE TO RELATED APPLICATION

This application is a continuation-in-part of copending commonly assigned application Ser. No. 552,649 filed Nov. 17, 1983, by Jensen and Triplet now abandoned.

BACKGROUND OF THE INVENTION

1. Field of the Invention

This invention relates to fabrics having useful electrical properties.

2. Introduction to the Invention

Compositions which have a positive temperature coefficient of resistance ("PTC compositions") are known. They can be composed of ceramic material, e.g. a doped barium titanate, or a conductive polymer material e.g. a dispersion of carbon black or other particulate conductive filler in a crystalline polymer. The term PTC is generally used (and is so used in this specification) to denote a composition whose resistivity increase's by a factor of at least 2.5 over a temperature range of 14° C. or by a factor of at least 10 over a temperature range of 100° C., and preferably both. The term switching temperature (or $T_s$) is generally used (and is so used in this specification) to denote the temperature at which the sharp increase in resistivity takes place, as more precisely defined in U.S. Pat. No. 4,237,441. Materials, in particular conductive polymer compositions, which exhibit zero temperature coefficient (ZTC) behavior are also known. In electrical devices which contain a PTC element and a ZTC element, the term ZTC is generally used (and is so used in this specification) to denote an element which does not exhibit PTC behavior at temperature below the $T_s$ of the PTC element; thus the ZTC element can have a resistivity which increases relatively slowly, or which is substantially constant, or which decreases slowly, at temperatures below the $T_s$ of the PTC element. Materials, in particular conductive polymer compositions, which exhibit negative temperature coefficient (NTC) behavior are also known. For further details of conductive polymer compositions and devices comprising them, reference may be made for example to U.S. Pat. Nos. 2,952,761, 2,978,665, 3,243,753, 3,351,882, 3,571,777, 3,757,086, 3,793,716, 3,823,217, 3,858,144, 3,861,029, 3,950,604, 4,017,715, 4,072,848, 4,085,286, 4,117,312, 4,177,376, 4,177,446, 4,188,276, 4,237,441, 4,238,812, 4,242,573, 4,246,468, 4,250,400, 4,255,698, 4,242,573, 4,271,350, 4,272,471, 4,276,466, 4,304,987, 4,309,596, 4,309,597, 4,314,230, 4,314,231, 4,315,237, 4,317,027, 4,318,881, 4,327,351, 4,330,704, 4,334,351, 4,352,083, 4,361,799, 4,388,607, 4,398,084, 4,413,301, 4,425,397, 4,426,339, 4,426,633, 4,427,877, 4,435,639, 4,429,216, 4,442,139, 4,459,473, 4,481,498, 4,476,450 and 4,502,929; J. Applied Polymer Science 19, 813–815 (1975), Klason and Kubat; Polymer Engineering and Science 18, 649–653 (1978), Narkis et al; and commonly assigned U.S. Ser. Nos. 601,424 now abandoned, published as German OLS No. 2,634,999; 732,792 (Van Konynenburg et al), now abandoned, published as German OLS No. 2,746,602; 798,154 (Horsma et al), now abandoned, published as German OLS No. 2,821,799; 134,354 (Lutz); 141,984 (Gotcher et al), published as European Applicaton No. 38,718; 141,988 (Fouts et al), published as European Application No. 38,718, 141,989 (Evans), published as European Application No. 38,713, 141,991 (Fouts et al), published as European Application No. 38,714, 150,909 (Sopory), published as UK Application No. 2,076,106A, 184,647 (Lutz), 250,491 (Jacobs et al) published as European Application No. 63,440, 272,854 and 403,203 (Stewart et al), published as European Patent Application No. 67,679, 274,010 (Walty et al), 300,709 and 423,589 (Van Konynenburg et al), published as European Application No. 74,281, 369,309 (Midgley et al), 483,633 (Wasley), 493,445 (Chazan et al), published as European Patent Application No. 128,664, 606,033, (Leary et al), published as European Application No. 119,807, 509,897 and 598,048 (Masia et al) published as European Application No. 84,304,502.2, 524,482 (Tomlinson et al) published as European Application No. 84,305,584.7, 534,913 (McKinley), 535,449 (Cheng et al) published as European Application No. 84,306,456.9, 552,649 (Jensen et al) published as European Application No. 84,307,984.9, 573,099 (Batliwalla et al) and 904,736, published as UK Patent Nos. 1,470,502 and 1,470,503, and the three commonly assigned applications filed Sept. 14, 1984, Ser. Nos. 650,918, 650,920 and 650,919 (MP0959, 961 and 962). The disclosure of each of the patents, publications and applications referred to above is incorporated herein by reference.

SUMMARY OF THE INVENTION

There are serious limitations in the known techniques for making electrical devices which contain PTC and/or ZTC elements composed of ceramic or conductive polymer materials. Ceramic materials are brittle and are difficult to shape, particularly when large or complex shapes are needed. Conductive polymers can be manufactured in a wide variety of shapes, but especially with PTC materials, close control is needed to ensure adequate uniformity; it is yet more difficult, if not impossible, to produce a predetermined variation in properties in different parts of an article. When a heat-shrinkable PTC conductive polymer article is required, there is the difficulty that when a PTC conductive polymer sheet is rendered heat-shrinkable (by stretching the cross-sheet above its melting point and then cooling it in the stretched state), the PTC of the heat-shrinkable sheet is often substantially smaller than that of the original sheet; this limits the stretch ratio that can be employed and, therefore, the available recovery.

In accordance with the present invention, we have now discovered that a wide range of electrical heaters can be easily and economically manufactured through the application (or adaptation) of known fabric-making techniques (particularly weaving, but including also, for example, knitting and braiding) to manufacture heaters which comprise elongate elements of at least two different types, one type comprising one of the electrodes and the other type (or one of the other types, if there are three or more different types) comprising a component composed of a material having a relatively high resistivity. Generally both the electrodes will be in the form of elongate elements which form part of the same fabric, and the invention will chiefly be described by reference to such fabrics. However, the invention also includes heaters in which the electrodes form part of different fabrics and heaters in which one of the electrodes is not part of a fabric, e.g. is a solid, stranded or apertured laminar, tape-like or wire-like element.

The fabric must contain at least one elongate element which comprises a component composed of a material which has sufficient resistivity, e.g. greater than $10^{-5}$ ohm.cm, particularly greater than $10^{-3}$ ohm.cm, to provide an effect which would not be obtained if the element consisted essentially of a metal. For example the component can be electrically resistive, in order to provide a heating effect; or electrically insulating (including insulating and non-tracking), to separate conductive components; or thermally responsive (e.g. heat-recoverable or thermally-activated-adhesive).

The novel heaters must comprise a resistive element which generates heat when the electrodes of the heater are connected to a power supply. The resistive element can be provided by (or by a part of) one of the elongate elements which form part of the fabric, and/or by a part of) one of the elongate elements which form part of the fabric, and/or by a separate element, e.g. a planar element which is adjacent to, the fabric or in which the fabric is wholly or partially embedded. The resistive element preferably exhibits PTC behavior such as may result from at least part of the element being composed of a PTC material whose resistivity decreases sharply at some elevated temperature). Particularly useful resistive elements are composed of a conductive polymer which comprises a polymeric component and a particulate conductive filler dispersed in the polymeric component.

Particularly important embodiments of the invention are those in which:

(A) at least one of the elongate elements in the fabric is an electrode, e.g. a metallic wire, which is a coated with a PTC material, particularly a PTC conductive polymer; such heaters preferably also comprise a ZTC material, particularly a conductive polymer, in which the fabric is embedded, so that current passing between the electrodes passes through the PTC and ZTC materials;

(B) at least one of the elongate elements is a resistive element which preferably comprises a PTC material, e.g. an element obtained by melt-extruding a PTC or ZTC conductive polymer; such heaters preferably comprise a fabric which comprises parallel metal electrodes and insulating elements running in one direction and the resistive elements running at right angles thereto;

(C) the fabric comprises parallel electrodes and insulating elements running in one direction, and insulating elements running at right angles thereto, and the resistive element is a planar element composed of a conductive polymer, preferably a PTC conductive polymer, in which the fabric is embedded; and (D) the fabric comprises elongate elements which are made of an insulating and non-tracking material, e.g one which is based on a polysiloxane, an ethylene/vinyl acetate copolymer or a thermoplastic rubber, and which preferably comprises a non-tracking material, e.g. alumina trihydrate and/or an iron oxide.

When the heaters are to be used over an extended period of time, it is important to minimize the contact resistance between the conductive components. We have found that this presents a particular problem when proper performance of the heater depends upon current flow between elongate elements which have been interlaced to form the fabric and whose outer surfaces are composed of a conductive polymer, especially when the heater is subject to bending. We have found that improved performance can be obtained by laminating at least one, and preferably both, of the faces of the fabric to a layer of polymeric material with the aid of heat under conditions such that the polymeric material flows into the fabric and the outer surfaces of said elongate elements are deformed (to provide improved electrical contact with adjacent surfaces, e.g. of wire electrodes). The pressure required in such a lamination is usually small and must not be such as to cause melting or flowing of the conductive polymer which would interfere with the desired performance of the heater. Cross-linking of the conductive polymer, e.g. by radiation, may be desirable in this and other embodiment of the invention for this and/or other purposes.

In one aspect, the present invention provides an electrical heater which comprises a fabric comprising elongate elements which are interlaced together in an ordered array and at least some of which comprise a component composed of material having a resistivity greater than $10^{-5}$ ohm.cm, said heater comprising (1) a first elongate electrode which forms at least part of one of said interlaced elongate elements;
(2) a second electrode; and
(3) a resistive element through which current passes when the first and second electrodes are connected to a source of electrical power and which has at least one of the following characteristics
  (a) it exhibits PTC behavior, and
  (b) it is composed of a conductive polymer which comprises a polymeric component and a particulate conductive polymer dispersed in the polymeric component.

In a preferred embodiment, the invention provides an electrical heater which comprises (1) a first elongate element which comprises
  (i) a first elongate electrode, and
  (ii) a first PTC element, preferably an elongate PTC conductive polymer element; and
(2) a second electrode which is spaced apart from the first electrode;

the first and second electrodes being connectable to a source of electrical power to cause current to pass through the PTC element; and the first elongate element forming part of a fabric in which the first elongate element is interlaced with at least one other elongate element to form an ordered array of interlaced elongate elements. In one preferred embodiment of such devices, the PTC element (which may be a single elongate PTC element or a plurality of discrete PTC elements spaced apart along the length of the electrode) electrically surrounds the first electrode, i.e. the device is so constructed and arranged that, when the electrodes are connected to a power source, substantially all the current passing between the electrodes passes through the PTC element, at least at some temperatures between room temperature and the equilibrium operating temperature of the device, and preferably at all temperatures. In another preferred embodiment, the heater comprises a third electrical element, preferably a ZTC conductive polymer element, through which current flows when the electrodes are connected to a power source; preferably substantially all the current passing between the electrodes passes through the third electrical element, at least at some temperatures between room temperature and the equilibrium operating temperature of the device, and preferably at all temperatures.

Particularly useful heaters for some purposes are those which comprise an element, preferably a non-conductive element, which is thermally responsive and which is heated when current is passed through the device. Such devices can be recoverable, either as a result of passing current through the device or as a result of some other action. For example, very useful heat-shrinkable articles comprise a woven fabric comprising spaced-apart first and second elongate electrodes running in one direction, and heat-shrinkable non-conductive elongate elements running in the other direction. The fabric can be impregnated or coated with a heat-softenable ZTC conductive polymer; alternatively or additionally the fabric can comprise elongate elements composed of a PTC conductive polymer. When the article is powered, the heat generated by Joule heating causes the non-conductive elements to shrink, and the ZTC material, if present, to soften, thus shrinking the fabric in the direction of the non-conductive elements and drawing the electrodes closer together.

The invention also includes processes in which a recoverable heater of the invention, especially one containing non-conductive heat-shrinkable filaments in the fabric, is used to cover a substrate, the process comprising:

(A) placing the device adjacent the substrate;
(B) recovering the device against the substrate, and
(C) passing current between the electrodes to effect a desired change in the non-conductive element.

Step (C) can be carried out before, simultaneously with, or after, step (B), and the recovery of the device can be effected by passing current between the electrodes or by some other means.

The invention also includes processes in which a heater of the invention is used to heat a substrate.

In another aspect the invention provides any electrically heatable fabric which comprises (1) a first electrode,
(2) a second electrode, and
(3) a fiber which exhibits PTC behavior, preferably a PTC conductive polymer fiber.

In addition to the various fabrics of this kind in which at least one of the electrodes is combined with another elongate element to form a fabric, this aspect of the invention includes for example heaters in which at least one of the electrodes is in the form of a fabric consisting essentially of metal wires or like highly conductive elements, and the PTC fiber connects the two electrodes, and heaters in which the electrodes and the PTC fiber are not interlaced to form part of the fabric but are merely secured to a fabric, e.g. one composed of electrically insulating fibers.

BRIEF DESCRIPTION OF THE DRAWING

The invention is illustrated in the accompanying drawing, in which the Figures are diagrammatic, partial views of devices of the invention; in particular.

DETAILED DESCRIPTION OF THE INVENTION

Figure 1:
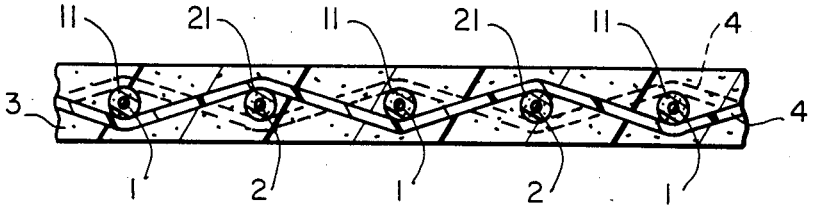
FIG. 1 is a cross-sectional side view of a heat-shrinkable device.

In the heaters of the invention, at least one and preferably each of the electrodes is an interlaced elongate electrode, usually of metal, e.g. copper or nickel-coated copper, for example a solid or stranded wire. In one preferred class, at least one of the electrodes is electrically surrounded by a PTC element preferably a PTC conductive polymer element. Usually the PTC element will be melt-shaped, preferably melt-extruded, preferably so that it physically surrounds the electrode as a uniform coating throughout its length; however, other methods of forming the PTC element, e.g. dip-coating, and other geometric arrangements, are possible. In another preferred class, the fabric comprises an interlaced elongate resistive element which comprises, and preferably consists essentially of, a PTC material, preferably a fibrous element (mono-filament or multifilament) made by melt-extruding a PTC conductive polymer. The PTC fiber or coating can vary in thickness and/or resistivity radially and/or longitudinally. Alternatively, the PTC element can alternate radially and/or longitudinally with polymeric elements having different electrical properties, e.g. which exhibit a different type of PTC behavior, which are electrically insulating, or which have a resistance which is much higher than the resistance of the PTC element at room temperature, so that at least when the device is at relatively low temperatures, substantially all the current between the electrodes passes through the PTC element (it is to be noted that the broad definition of the devices of the invention does not exclude the possibility that at temperatures close to and above the $T_s$ of the PTC element, a substantial part of the current does not pass through the PTC element). The PTC element can be in direct physical contact with the electrode or can be separated therefrom by a layer of ZTC material, for example a low resistivity conductive polymer, which may be applied to the electrode as a conductive paint. The dimensions of the PTC element and the resistivity and other properties of the PTC composition should be correlated with the other elements of the device, but those skilled in the art will have no difficulty, having regard to their own knowledge (e.g. in the documents referenced herein) and the disclosure herein, in selecting suitable PTC elements. Suitable polymers include polyethylene and other polyolefins; copolymers of one or more olefins with one or more polar comonomers e.g. ethylene/vinyl acetate, ethylene/acrylic acid and ethylene/ethylacrylate copolymers; fluoropolymers, e.g. polyvinylidene fluoride and ethylene/tetrafluoroethylene copolymers; and polyarylene polymers, e.g. polyether ketones; and mixtures of such polymers with each other and/or with elastomers to improve their physical properties.

The second electrode in the preferred devices is preferably another elongate electrode which forms part of the same fabric as the first electrode (as is usually preferred) or part of a different fabric. The second electrode can be the same as or different from the first electrode. Electrical contact between the first and second electrodes can be achieved in any suitable way. For example, the second electrode can be in contact with a PTC element surrounding the first electrode; or it can be electrically surrounded by a second PTC element which has the same or a different $T_s$ as the first PTC element and is in physical contact with another electrical element; or it can be in direct physical contact with another electrical element as described above. Alternatively the second electrode can be an elongate electrode which is not interlaced to form part of a fabric, or it can be a laminar electrode, e.g. a metal foil, apertured metal, or vapor-deposited metal electrode.

One preferred class of heaters comprises a ZTC conductive polymer element. This ZTC element can be of uniform composition or can comprise discrete sub-elements; for example it may be desirable to coat an electrode or a PTC element surrounding an electrode with a first ZTC conductive polymer in order to provide improved electrical and physical contact to a second ZTC conductive polymer. The third electrical element can fill or bridge the interstices of the fabric(s), thus providing a continuous laminar element. Alternatively, the third electrical element can be coated onto the fabric(s) so that apertures remain in the fabric. In another embodiment, part (or all) of the ZTC element is provided by an elongate element which is interlaced with at least one other elongate element to form part of the fabric(s), with the remainder (if any) of the ZTC element being coated on or otherwise united to the fabric to provide desired electrical contact between the elongate elements. The ZTC electrical element can be thermally responsive, e.g. heat-shrinkable. The dimensions of the ZTC electrical element and the resistivity and other properties of the ZTC conductive polymers preferably used for it should be correlated with the other elements of the device, but those skilled in the art will have no difficulty, having regard to their own knowledge (e.g. in the documents referenced herein) and the disclosure herein, in selecting suitable ZTC elements. When the device is recoverable, the ZTC element preferably has low viscosity at the recovery temperature so that it impedes recovery as little as possible. Suitable polymers for the ZTC material include copolymers of ethylene with one or more polar copolymers, e.g. ethyl acrylate and vinyl acetate.

The first electrode (and any other elongate elements) can be formed into a fabric by any method which results in an ordered array of interlaced elongate elements. Weaving is the preferred method, but knitting, braiding etc. can be used in suitable cases. The density of the weave (or other form of interlacing) can be selected in order to provide the desired power output or shrinkability (when the fabric incorporates shrinkable elements as described below) or other property. Similarly, the density of the weave can be varied from one area to another to provide a desired variation, e.g. of at least 10% or at least 25%, in one or more properties from one discrete area (which may be, for example, at least 5% or at least 15% of the total area) to another. Triaxial weaving can be employed.

In order to pass current through the device, the electrodes must of course be connected to a power source, which may be DC or AC, e.g. relatively low voltage, e.g. 12, 24 or 48 volts, or conventional line voltages of 110, 220, 440 or 600 volts. The various components of the device must be selected with a view to the power source to be employed. When the electrodes are elongate electrodes, they may be powered from one end or from a number of points along their lengths; the former is easier to provide, but the latter results in more uniform power generation.

The device may include, at least in selected areas thereof, a non-conductive element which provides desired properties, particularly a non-conductive element which is thermally responsive and which is heated when current is passed between the electrodes; or a non-conductive element, e.g. of glass fibers, which provides stiffness or other desired physical properties; or a non-conductive element which is composed of a non-tracking material in order to inhibit the deleterious effects of arcing. The non-conductive element can be, for example, a heat-recoverable, e.g. heat-shrinkable, element. Such heat-recoverable elements can for example be composed of an organic polymer (which can be cross-linked) or a memory metal alloy. Other useful thermally responsive members include a layer of a hot melt adhesive or a mastic; a thermochromic paint; or a component which foams when heated. The non-conductive element can be an elongate element which forms part of the fabric(s) incorporating the elongate electrode(s), e.g. a continuous monofilament or multifilament yarn or a staple fiber yarn. Suitable heat-shrinkable elements can be composed of, for example, a polyolefin, e.g. high, medium or low density polyethylene; a fluoropolymer, e.g. polyvinylidene fluoride; a polyester, e.g. poly- terephthalate or poly butylene terephthalate; or a polyamide, e.g. Nylon 6, Nylon 6,6, Nylon 6, 12, Nylon 11 or Nylon 12. The element is preferably capable of unrestrained recovery to less than 50%, preferably less than 35%, especially less than 25% of its stretched dimension.

One preferred embodiment of the invention is a heat-shrinkable device which is useful, for example, for protecting joints between elongate substrates such as telephone cables. Such a device can for example comprise (1) a first elongate electrode which comprises
  (i) a first elongate electrode composed of metal and
  (ii) a first PTC element composed of a first conductive polymer composition;
(2) a second elongate element which comprises a second elongate electrode composed of a metal;
(3) a heat-shrinkable elongate element which shrinks when heated to a temperature $T_{shrink}$ and which is composed of an electrically insulating polymeric composition;

said first, second and heat-shrinkable elongate elements having been woven together to form a fabric; and (4) a ZTC electrical element which is composed of a third conductive polymer composition;

the first and second electrodes being connectable to a source of electrical power to cause current to flow through the ZTC element and to cause shrinkage of the heat-shrinkable element, and the PTC element being positioned so that, when the electrodes are connected to a power source, substantially all the current passing through the electrodes passes through the PTC element.

The electrodes generally run in one direction in the fabric (which may be the warp or the weft, depending on the ease of weaving). If the fabric contains a heat-shrinkable element, it usually runs at right angles to the electrodes. This enables the electrodes to accommodate to shrinkage of the heat-shrinkable elements by moving closer together, without longitudinal shrinkage.

The electrodes can be powered from one end, in which case they will normally have a serpentine shape. Alternatively the fabric can be woven so that each of the electrodes is or can be exposed at regular intervals along the fabric, e.g. each time it changes direction, thus permitting the exposed portions to be bussed together by some bussing means which permits the desired shrinkage to take place. Generally, the exposed portions of the first electrodes will be joined together along one edge of the fabric and the exposed ends of the second electrode will be joined together along the opposite edge of the fabric.

In devices containing heat-shrinkable elements, it is important that the heat generated, e.g. in the conductive polymer elements, is sufficient to raise the heat-shrinkable elements to their shrinkage temperature. In order to ensure that there is adequate heating of the ZTC element before the PTC element shuts off, it is preferred that the resistance of the ZTC element is greater than, preferably at least 1.2 times, the resistance of the PTC element(s) at all temperatures between 0° C. and $T_{shrink}$. When the ZTC element forms a continuous laminar element (as is usually preferred in order to protect the substrate against which the device is to be recovered), this usually means that the resistivity of the ZTC composition is greater than, preferably at least twice, the resistivity of the PTC composition at all temperatures between 0° C. and $T_{shrink}$.

In these devices, it is preferred that the first conductive polymer composition comprises a first polymeric component which contains at least 50% by volume of a crystalline polymer having a first melting point $T_1$ and which has a first resistivity $\rho_1$, the ZTC conductive polymer composition comprises a polymeric component which contains at least 50% by volume of a thermoplastic polymer having a softening point $T_2$ and a resistivity $\rho_2$; wherein $$T_1 > T_{shrink} > T_2$$

and $$\rho_2 > \rho_1 \text{ at all temperatures between } 0° \text{ C. and } T_{shrink}.$$

It is also preferred that $(T_1 - T_2)$ is at least 30° C., particularly at least 50° C., and that $(T_1 - T_{shrink})$ is at least 10° C., preferably at least 20° C. We have obtained good results when the polymer is polyvinylidene fluoride, the polymer in the ZTC composition is a copolymer of ethylene, e.g. an ethylene/ethyl acrylate polymer, and the heat-shrinkable element comprises polyethylene.

The thermal properties of the device and of the surroundings are important in determining the behavior of the device. Thus the device can comprise, or be used in conjunction with, a thermal element which helps to spread heat uniformly over the device, e.g. a metal foil layer, or which reduces the rate at which heat is removed from the device, e.g. a layer of thermal insulation such as a foamed polymer layer.

The fabric may be laminated with a material to render it impermeable, to strengthen it, to improve heat dissipation or otherwise to alter its electrical properties. Instead of or in addition to such lamination, a material may be applied to improve electrical contact between the first and second electrodes on the one hand and the PTC fiber on the other hand. A suitable material for this purpose comprises a conductive paint. Electrical contact may also be improved by subjecting the fabric or the laminate to compression, for example by passing it through nip rollers.

One may alter the electrical properties of the heater by incorporating into it two or more PTC materials having different temperature coefficients of resistance. For example, one PTC material may be present as a PTC fiber and another as a jacket encasing a wire electrode. Alternatively the heater can contain a PTC fiber comprising two or more materials having different temperature coefficients of resistance, e.g. a PTC fiber in tape form whose orientation is fixed relative to electrodes with which it is interlaced. Tape-like fibers have the advantage of increased contact area with the electrodes. Thus the tape may comprise a strip of material having a high switching temperature (a temperature or range of temperatures at which a substantial change in resistivity occurs) laminated to a strip of material having a lower switching temperature. Such a tape can be interlaced as part of a fabric such that, say, the material of lower switching temperature contacts only phase electrodes and the material of higher switching temperature contacts only neutral electrodes. The result is a much sharper switching temperature than would be achieved if either of the materials were used separately.

Referring now to the drawing, FIG. 1 is a partial cross-sectional side view of a device of the invention, showing electrodes 1 of one polarity, each surrounded by a PTC conductive polymer element 11, and parallel electrodes 2 of opposite polarity, each surrounded by a PTC conductive polymer element 21. The electrodes are woven into a fabric with heat-shrinkable non-conductive filaments 4 at right angles to the electrodes, and the fabric is impregnated or coated with ZTC conductive polymer element 3.

Figure 2:
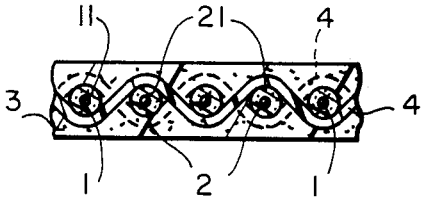
FIG. 2 is a cross-sectional side view of the device of FIG. 1 after it has been powered to effect shrinkage.

FIG. 2 is a partial cross-sectional side view of the device of FIG. 1 after it has been powered to cause shrinkage of the filaments 4 and softening of the ZTC element 3.

Figure 3:
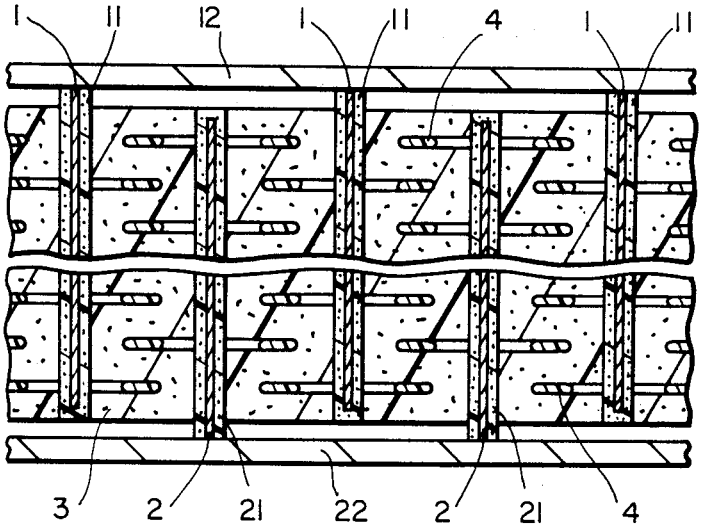
FIG. 3 is a plan view of the device of FIG. 1.

FIG. 3 is a partial cross-sectional plan view of a device as shown in FIG. 1. The electrodes 1 are connected at one end to a bus bar connector 12 which runs along one edge of the fabric and does not prevent shrinkage of the filaments 4 when they are heated. Similarly the electrodes 2 are connected at one end to a bus bar connector 22 which runs along the opposite edge of the fabric and does not prevent shrinkage of the filaments 4 when they are heated. The ZTC element 3 completely fills the interstices of the fabric.

Figure 4:
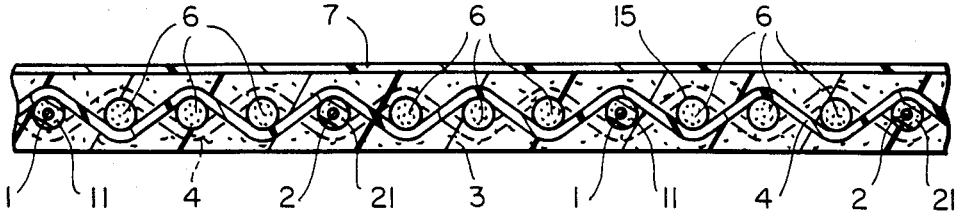
FIG. 4 is a cross-sectional side view of another heat-shrinkable device.

FIG. 4 is similar to FIG. 1 and shows the same elements 1, 2, 3, 4, 11 and 21, and in addition shows elongate elements 6 which are woven into the fabric parallel to the PTC elements and are composed of a hot melt adhesive 15 which melts at the shrinkage temperature of the filaments 4. Also shown in FIG. 4 is an electrically insulating polymeric backing 7 which softens at the shrinkage temperature of the filaments 4.

Figure 5:
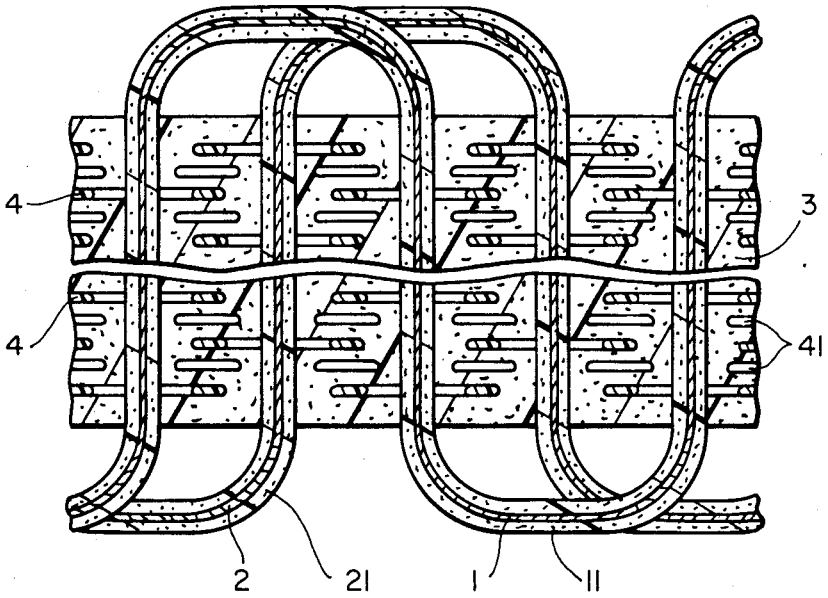
FIG. 5 is a cross-sectional plan view of a device similar to that shown in FIGS. 1 and 2, but in which the electrodes are differently arranged and the ZTC element coats but does not fill the fabric.

FIG. 5 is a partial cross-sectional plan view of another device of the invention which is similar to that shown in FIGS. 1 and 3, but in which the electrodes follow a serpentine path and are powered from one end, and the ZTC element 4 coats the fabric but does not fill its interstices, leaving a plurality of voids 41.

Figure 6:
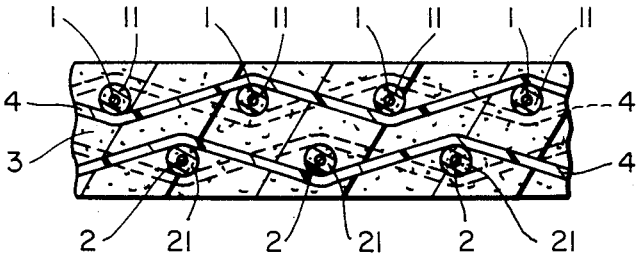
FIG. 6 is a cross-sectional side view of another device similar to that shown in FIGS. 1 and 2 but in which one of the electrodes is woven into one fabric and the other electrode is woven into another fabric, and the two fabrics are secured together by the ZTC element.

FIG. 6 is a partial cross-sectional side view of another device of the invention which is similar to that shown in FIGS. 1 and 2 except that the electrodes 1 are woven into one fabric with half of the heat-shrinkable filaments 4, while the electrodes 2 are woven into a second fabric with the other half of the heat-shrinkable filaments 4. The fabrics are secured to each other by the ZTC conductive polymer element.

Figure 7:
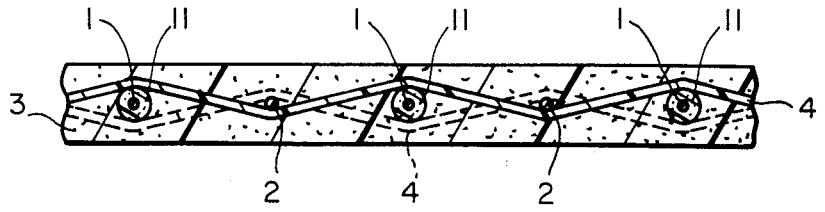
FIG. 7 is a cross-sectional side view of a device similar to that shown in FIG. 1 in which only one of the electrodes is coated with a PTC element.

FIG. 7 is a partial cross-sectional side view of another device of the invention which is very similar to that shown in FIG. 1 but in which there is no PTC coating around the electrodes 2.

Figure 8:
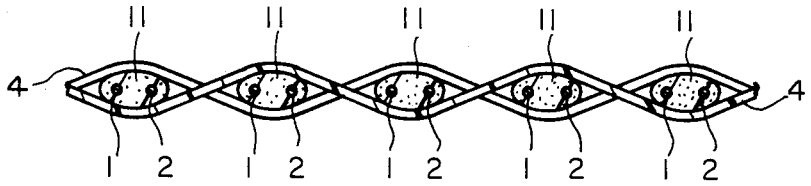
FIG. 8 is a cross-sectional side view of another device of the invention.

FIG. 8 is a partial cross-sectional side view of another device of the invention which comprises electrodes 1 and 2 embedded in a PTC element 11 to form a self-limiting strip heater preferably having an outer insulating jacket (not shown). The strip heater is woven into a fabric with heat-shrinkable filaments 4.

Figure 9:
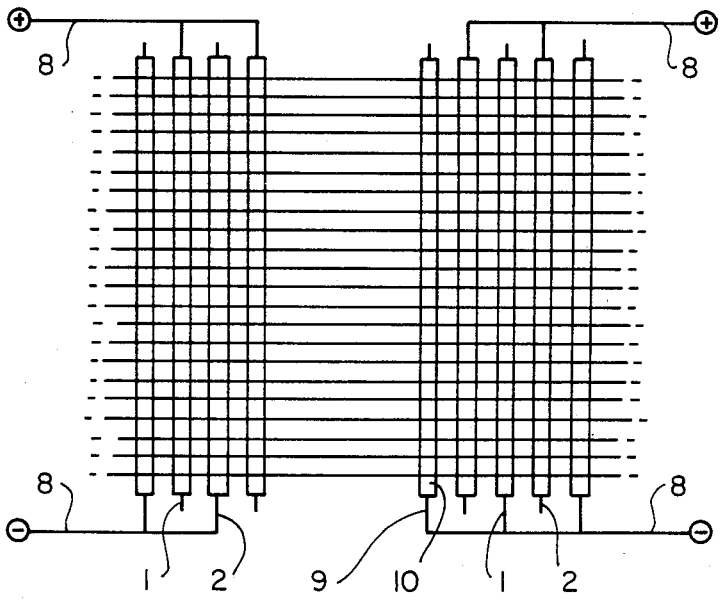
FIG. 9 is a plan view of a fabric heater in which the electrodes and a PTC fiber are woven into a fabric.

FIG. 9 shows an electrically heatable fabric that is a plain weave of a first electrode 1, a second electrode 2 and a PTC fiber 3. The first and second electrodes and the PTC fiber may each comprise a series of elongate conductors (including partial conductors), as drawn, or one or more of them may comprise a single continuous length of conductor. It will be seen that connection of a source of electrical power (represented by the plus and minus signs) will cause current to flow through the PTC fiber. It will clearly be necessary that a conductor of the first electrode 1 does not directly electrically contact an adjacent conductor of the second electrode 2. If the PTC fiber has sufficient crimp, direct contact may be avoidable. However, it may be necessary to incorporate an insulating fiber 4 (shown dotted on the left hand side of the Figure) between adjacent electrode conductors. The number of insulating fibers between each pair of conductors will depend on fiber size, type and density of weave etc.

The design illustrated can conveniently be powered by a voltage of from 110–240 to give a heat output of 2 w/sq.in.

In FIG. 2 first and second electrodes, 1, 2, each comprises a woven fabric of warp fibers 5 and weft fibers 6, for example copper wire, particularly multi-stranded wire for increased flexibility. (No particular weave design is indicated in this and subsequent plan views, since no distinction is shown between an overlying and an insulating layer 7. A PTC fiber 3 passes from one electrode to the other through the insulating layer. The PTC fiber 3 may be applied as a stitch over the surface of the laminate, although only two rows of stitching are shown for clarity.

Figure 10:
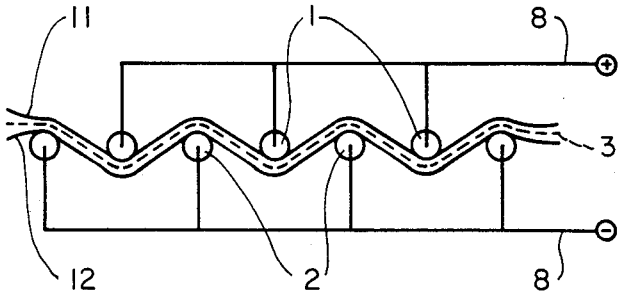
FIG. 10 is an exploded view of a fabric heater in which the electrodes are woven fabrics which are separated by insulation and joined by PTC fibers which pass through the insulation.

It will be seen that the designs of FIGS. 9 and 10 each provide a large number of small heating regions or cells which operate individually. Localized damage does not therefore seriously affect overall performance of the heater.

Figure 11:
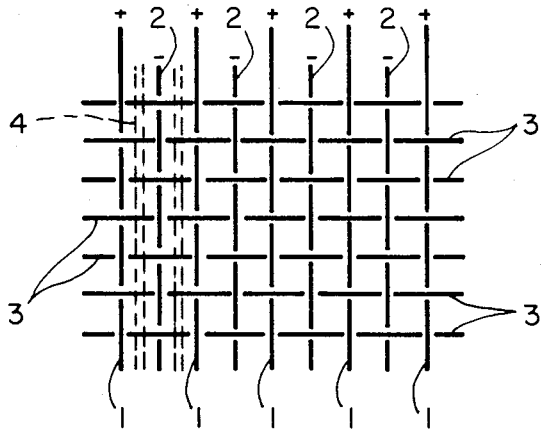
FIGS. 11 and 12 show heaters incorporating two different PTC materials.

In FIG. 11 two embodiments are shown where the current passes through at least two PTC materials of different switching temperatures. On the left hand side of the Figure both electrodes 1 and 2 comprise a metal conductor 9 surrounded by a layer of PTC material 10. thus the current passes through two PTC layers 10 and the PTC fiber 3. On the right hand side only electrode 1 is surrounded by PTC material 10. A very sharp switching temperature can be achieved.

Figure 12:
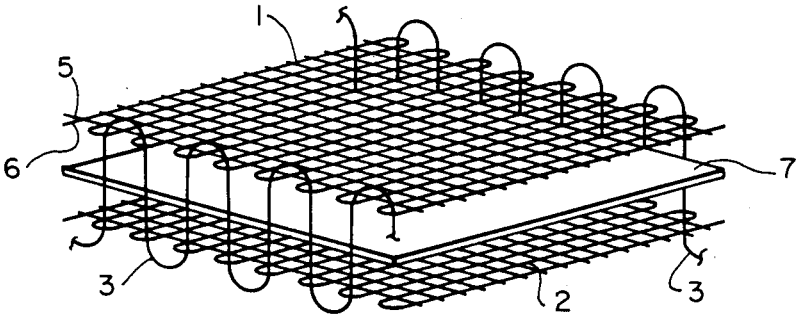

In FIG. 12 the PTC fiber 3 itself comprises at least two different PTC materials 11 12. The PTC fiber 3 preferably has the form of a tape such that one material 11 reliably contacts only the firt electrode 1 and material 12 contacts only the second electrode 2.

For further details of techniques for preparing fabrics and for using heat-shrinkable fabric materials, and of heat-responsive materials which can be incorporated into or form part of fabrics, reference may be made to copending commonly assigned Applications Ser. Nos. 561,022, 561,027, 567,121, 567,122, 567,126, 567,127, 567,128, 567,129 and 584,045. The disclosures of these applications is incorporated herein by reference. The invention is illustrated by the following Examples.

EXAMPLE 1

A satin weave fabric was prepared using the following elongate elements:

1. a 24 AWG nickel-coated copper stranded wire conductor having a uniform melt-extruded coating thereon, about 0.008 inch thick, of a PTC conductive polymer composition which had a resistivity of about 40 ohm.cm at 25° C. and over 500 ohm.cm at 130° C., and which comprised carbon black dispersed in polyvinylidene fluoride;

2. a monofilament which is about 0.01 inch in and which is composed of a polyamide hot melt adhesive; and 3. a high density polyethylene about 5 grams per denier monofilament which had been drawn down about 20 to 30 times immediately after extrusion, and which was therefore heat-shrinkable, with a $T_{shrink}$ of about 128° C.

The weft of the fabric was composed of elements (1) and (2), there being three elements (2) between each of the elements (1), and the elements (1) being 0.3 inch apart (center-to-center). The warp of the fabric was composed of elements (3) at a frequency of 72 filaments per inch.

The fabric was then irradiated to a dosage of 12–17 Mrad, thus cross-linking PTC conductive polymer and the polyethylene.

The irradiated fabric was laminated under heat and pressure to a 0.03 inch thick sheet of a conductive polymer composition which had a resistivity of about 80 ohm.cm at 25° C. and about 200 ohm.cm at 140° C. [i.e. it was ZTC compared to the PTC composition of element (1)], and which comprised carbon black dispersed in a very low crystallinity ethylene/ethyl acrylate copolymer. At the same time, the opposite face of the fabric was laminated to a 0.011 inch thick layer of an insulating polymeric composition.

The resulting product had a cross-section similar to that shown in FIG. 4. The electrodes followed a serpentine pattern similar to that shown in FIG. 5.

When the electrodes were connected to a 36 volt DC power source, the fabric heated to a temperature of about 130° C., at which temperature the polyethylene filaments had reached their shrinkage temperature, and the hot-melt adhesive filaments and ZTC layer had softened; the fabric therefore shrank in the transverse direction to about 33% of the original transverse dimension.

EXAMPLE 2

A PTC fiber having a diameter of 0.04 inch was made by melt-extruding a PTC conductive polymer composition comprising carbon black dispersed in a mixture of polyethylene and an ethylene/ethyl acrylate copolymer, followed by irradiation to a dosage of about 7 Mrads to cross-link the polymer. A fabric was then woven in which the warp consisted of commercially rayon fibers and, at intervals of 0.4 inch, three contiguous wires, each a 30 AWG nickel-coated copper solid wire which had been coated with a conductive paint containing graphite (Electrodag 502), and the weft consisted of the same rayon fibers and, at intervals of about 0.11 inch, a PTC fiber prepared as described above.

The resulting fabric was placed between two sheets of an ethylene/propylene rubber (sold by Uniroyal under the trade name TPR 8222B) and the assembly was laminated between silicone pads at 450° F. for one minute, using minimum pressure.

The resulting product was trimmed, and the wires exposed along the edges of the heater to give a heater as shown diagrammatically in FIG. 9. The heater had a stable resistance and a low Linearity Ratio (ratio of resistance at 100 volts AC to resistance at 0.04 volts AC) of less than 1.1, even after flexing.

We claim:

1. An electrical heater which comprises a fabric comprising elongate elements which are interlaced together in an ordered array and at least some of which comprise a component composed of material having a resistivity greater than $10^{-5}$ ohm.cm, said heater comprising (1) a first elongate electrode which forms at least part of one of said interlaced elements;

(2) a second elongate electrode which forms at least part of one of said interlaced elements;

(3) a PTC element which is in the form of a layer electrically surrounding the first electrode and which (a) exhibits PTC behavior, and (b) is composed of a conductive polymer which comprises a polymeric component and particulate conductive polymer dispersed in the polymeric component; and (4) a substantially continuous laminar element which is composed of a ZTC conductive polymer and through which current passes when the electrodes are connected to a source of electrical power.

2. A heater according to claim 1 wherein one of said interlaced elongate elements is an element which is electrically non-conductive.

3. A heater according to claim 2 wherein said non-conductive element is thermally responsive.

4. A heater according to claim 2 wherein said non-conductive element is heat-recoverable.

5. A heater according to claim 2 wherein said non-conductive element is composed of a non-tracking polymeric composition.

6. A heater according to claim 4 wherein each of the first and second electrodes is composed of a metal, and the non-conductive element is a heat-shrinkable elongate element which shrinks when heated to a temperature $T_{shrink}$ and which is composed of an electrically insulating polymeric composition;

said first, second and heat-shrinkable element is a heat-fabric prepared by weaving the first, second and heat-shrinkable elements together;

whereby, when the first and second electrodes are connected to a suitable source of electrical power, current flows through the ZTC element and causes shrinkage of of the heat-shrinkable element.

7. A heater according to claim 6 wherein at all temperatures between 0° C. and $T_{shrink}$ of the heat-shrinkable element, the resistance of the ZTC element is greater than the resistance of the PTC element.

8. A heater according to claim 1 wherein at least one of said interlaced elements consists essentially of a PTC conductive polymer which is different from the conductive polymer which is in the form of a layer surrounding the first electrode.

9. A heater according to claim 1 which comprises at least one layer of polymeric material which has been laminated to the fabric with the aid of heat and pressure under conditions such that the polymeric material flows into the fabric and the outer surface of the PTC element surrounding the first electrode is deformed but does not melt or flow.

10. A heater according to claim 1 which comprises a fabric prepared by weaving together a first elongate element which consists of the first electrode in the form of a metal wire and the PTC element surrounding the first electrode, and a second elongate element which consists of the second electrode in the form of a metal wire.

* * * * *

UNITED STATES PATENT AND TRADEMARK OFFICE

CERTIFICATE OF CORRECTION

PATENT NO. : 4,700,054

DATED : October 13, 1987

INVENTOR(S) : James T. Triplett, et al.

It is certified that error appears in the above-identified patent and that said Letters Patent is hereby corrected as shown below:

In Column 3, line 23, delete "decreases" and insert --increases--.

In Column 4, line 27, delete "polymer" and insert --filler--.

In Column 8, line 38, delete "poly-terephthalate" and insert --polyethylene terephthlate--.

In Claim 1, line 16, delete "polymer" and insert --filler--.

In Claim 6, lines 7 to 8, delete "element is a heat-fabric" and insert --elements forming a fabric--.

In Claim 6, line 13, delete the first "of".

Signed and Sealed this

Nineteenth Day of July, 1988

*Attest:*

*Attesting Officer*

DONALD J. QUIGG

*Commissioner of Patents and Trademarks*